US007219523B2

(12) United States Patent
Muschalik

(10) Patent No.: US 7,219,523 B2
(45) Date of Patent: May 22, 2007

(54) EXTRUDER FOR MAKING CURVED METAL WORKPIECE

(75) Inventor: Uwe Muschalik, Duisburg (DE)

(73) Assignee: SMS Eumuco GmbH, Leverkusen (DE)

( * ) Notice: Subject to any disclaimer, the term of this patent is extended or adjusted under 35 U.S.C. 154(b) by 0 days.

(21) Appl. No.: 10/524,645

(22) PCT Filed: Aug. 5, 2003

(86) PCT No.: PCT/DE03/02622

§ 371 (c)(1),
(2), (4) Date: Jan. 19, 2006

(87) PCT Pub. No.: WO2004/020121

PCT Pub. Date: Mar. 11, 2004

(65) Prior Publication Data

US 2006/0174675 A1 Aug. 10, 2006

(30) Foreign Application Priority Data

Aug. 8, 2002 (DE) ..... 102 36 299

(51) Int. Cl.
*B21C 23/00* (2006.01)

(52) U.S. Cl. ..... 72/256; 72/257

(58) Field of Classification Search ..... 72/256, 72/257, 260, 467, 253.1
See application file for complete search history.

(56) References Cited

U.S. PATENT DOCUMENTS

| | | | | |
|---|---|---|---|---|
| 2,954,121 | A * | 9/1960 | Benson | 72/257 |
| 5,305,626 | A * | 4/1994 | Tiekink | 72/257 |
| 6,634,200 | B2 * | 10/2003 | Kleiner et al. | 72/260 |
| 6,952,942 | B2 * | 10/2005 | Graefe et al. | 72/256 |
| 2006/0156780 | A1 * | 7/2006 | Birkenstock | 72/257 |

* cited by examiner

*Primary Examiner*—Ed Tolan
(74) *Attorney, Agent, or Firm*—Andrew Wilford

(57) ABSTRACT

An extruder for making a curved workpiece has an extruder frame including a counterbeam extending transversely of an extrusion direction and formed with a recess that is through-going in the direction and a tool recessed in the recess and including a die having a downstream face spaced upstream in the direction from a downstream side of the counterbeam. A hot metal block is pressed against an upstream face of the die to extrude a strand in the direction from the downstream face of the die. Immediately downstream of the die a transverse external force is applied to the strand to bend it. The tool includes a pressure plate that extends completely through the counterbeam in the extrusion direction.

4 Claims, 1 Drawing Sheet

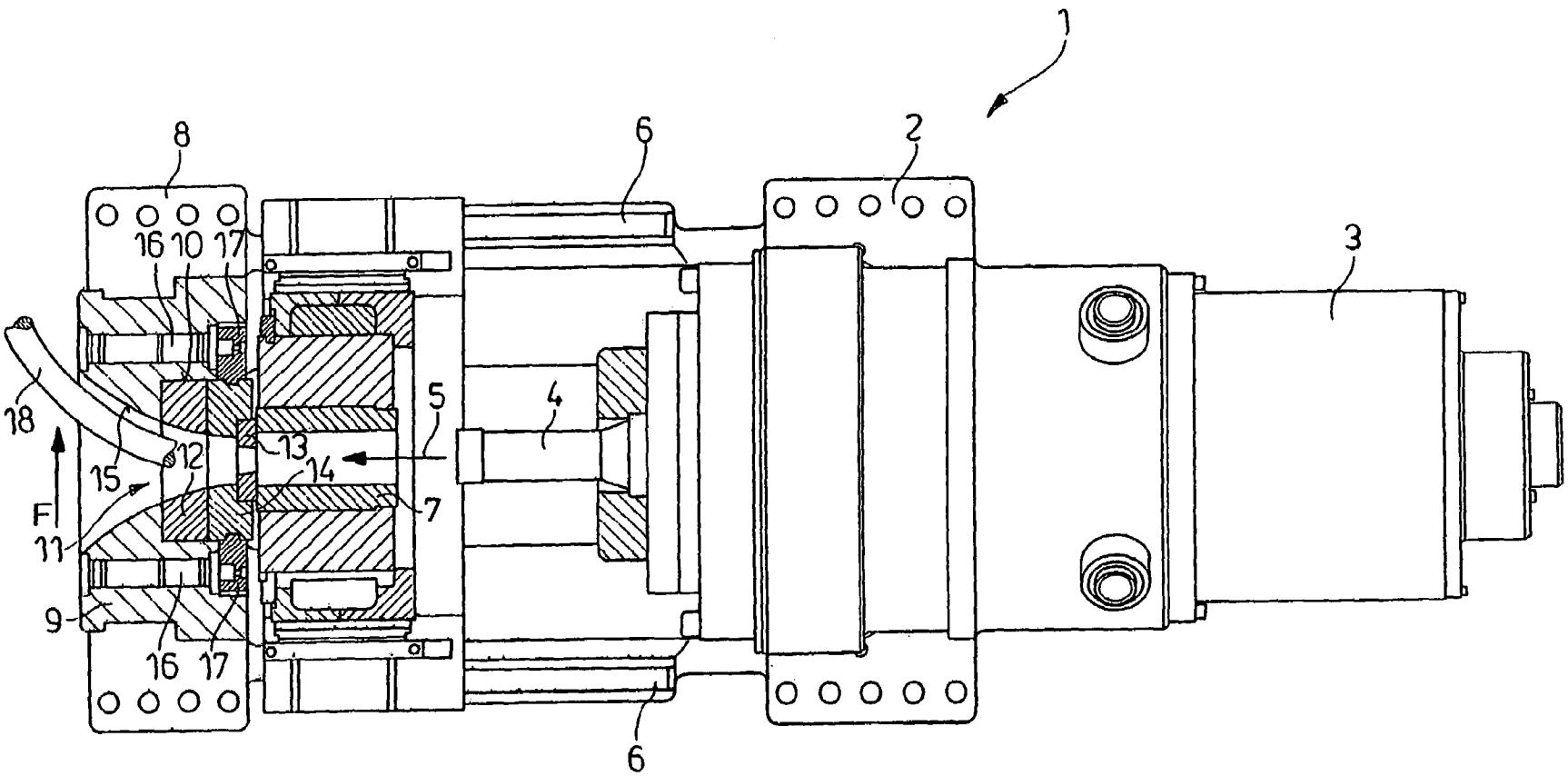
1
2
3
4
5
6
6
7
8
9
10
11
12
13
14
15
16
16
17
17
18
F

EXTRUDER FOR MAKING CURVED METAL WORKPIECE

CROSS REFERENCE TO RELATED APPLICATIONS

This application is the US national phase of PCT application PCT/DE2003/002622 filed 5 Aug. 2003 with a claim to the priority of German patent application 10236299.8 itself filed 8 Aug. 2002.

FIELD OF THE INVENTION

The invention relates to an extrusion press or extruder, especially for producing curved extruded products, where pressed in a tool arranged on a counterbeam or traverse of the extruder which usually encompasses a pressure part and a die-receiving die holder, the pressed product is shaped and is then curved or bent by the effect of external forces.

BACKGROUND OF THE INVENTION

To manufacture curved or bent extruded sections or profiles which are generally composed of aluminum and magnesium alloys as required for various purposes in different industrial fields, it is known from EP 0 706 843 B1 to provide an extruder for hollow products with large wall thickness differences that applies force at least at defined distances from the die outlet or counterbeam, using a pressure medium which produces a reaction effect upon the profile or section shaped in the extruder die. The pressing means can be a pressing roller or a sliding surface generating a transverse force or a roller cage. Independently of the pressure applying means which is used to bring about the reaction force, a certain distance must be maintained if the extruded product is to be bent or curved simultaneously with or directly after shaping by the extrusion process in such manner that the workpiece cross sections formed in the extrusion die do not emerge parallel to one another from the die but rather are assume an angle to one another. With this arrangement it is however not possible to produce sections with small bending radii.

OBJECT OF THE INVENTION

It is the object of the invention, therefore, to provide an extruder for the purposes described which enables with simple means the production of a pressed product with a wide range of bending radii.

SUMMARY OF THE INVENTION

This object is attained, in accordance with the invention in that the entire tool is disposed in the counterbeam or traverse. In this manner, deviating from all known embodiments of extruders in which the tool or the die of the counterbeam is provided ahead or upstream of the pressing unit, the tool according to the invention can always project slightly out of the counterbeam, but predominantly, however, is received or recessed in and anchored in the counterbeam with at least a shoulder toward the side or end facing in the direction of the press ram or the receiver holding the block or blank of metal to be extruded so that the extruded strand outlet can be located as close as possible to the exterior. This ensures earlier action on the strand to be bent than has hitherto been the case so that small bending radii can be formed thereon while the free end of the strand which is subjected to bending will undergo the bending effect after the much shorter outlet length from the die than has hitherto been the case. Depending upon the force application direction of the pressure applying means, radii in different directions are possible.

A refinement of the invention provides that the tool is provided in an enlarged pressure plate in the press direction which extends over the full length of the counterbeam. This allows compensation for a possible weakening of the pressure plate by such overdimensioning because of the recess or opening in which the integrated tool is received.

According to a preferred feature of the invention an increasingly widening outlet funnel is formed in the tool starting from the die and extending in the press direction outwardly in the press plate. In this manner not only is a free space provided to accommodate the bending or curvature of the strand but the formation of the smallest radii is further ensured because the deflection and thus the curvature of the strand can be commenced already within the counterbeam and the outlet funnel by the pressure when, in accordance with a further proposal of the invention, cylinders are arranged in the pressure plate parallel to the outlet funnel and are coupled with the tool, the entire tool can be moved out of the counterbeam rearwardly for the purpose of maintenance or replacement axially into a freely accessible position.

BRIEF DESCRIPTION OF THE DRAWING

Further features and details of the invention are given in the claims and the following description of an embodiment of the invention illustrated in the single drawing FIGURE.

SPECIFIC DESCRIPTION

In the extruder 1 shown in the drawing and illustrated in a horizontal construction, in a cylinder beam 2, a press piston 3 is arranged with which a press ram 4 can be driven in the press direction 5 (see the arrow). The ram 4 presses a block, not shown, which has previously been inserted into a receiver 7 which can be moved back and forth on slide guides 6 by means of shifting cylinders (not shown). The drawing shows the receiver 7 after it has assumed its working position adjacent a counterbeam 8. The cylinder beam 2 and the counterbeam 8 can for example be connected by pressure posts and tension rods to a compact press frame with these elements in force-transmitting relationship with one another.

The counterbeam 8 is here provided with an enlarged pressure plate 9 which forms a component of the counterbeam 8. In the pressure plate 9 a recess or cut-out 10 is provided which receives the tool 11 here constituted by a pressure piece 12, a die holder 14 connected thereto by screws and a die 13 carried by the die holder 14. The tool 11 is thus an integrated component of the counterbeam 8 with which the end of the receiver 7 confronting it forms a snug contact, thereby bringing the block to be extruded to the die without any gap between the receiver and the die.

The tool 11 and the pressure plate 9 are formed with a tool funnel 15 starting at the inner side or downstream face of the die 13 and widening outwardly downstream in the press direction 5. In the pressure plate 9 there are provided cylinders 16 parallel to the funnel 15 which are accessible without hindering from outside the counterbeam 8 and coupling pieces 17 fixed to their piston rods can be coupled by detent formations with the tool 11 or the die holder 17. For the maintenance or replacement or the like of the counterbeam 8, the tool 11 can be displaced from the position shown in the drawing after the receiver 7 has been rearwardly shifted upstream into its inoperative position, by energization of the cylinder 16 out of the mounted position in the recess 10 of the enlarged pressure plate and opposite the press direction 5 into a freely accessible position spaced axially upstream of the counterbeam 8.

In the pressing of a strand 18 as has been schematically illustrated, by appropriate pressure applying means indicated by the force arrow F, previously actuated, a small radius of curvature can be imparted to the strand 18. Since the tool 11 is fully housed or recessed in the counterbeam 8, this force can be applied as close to where the strand 18 exits the counterbeam 8 as possible and thus such that the leading end of the strand 18, that is the strand length between where the force F is applied and where it exits the die 13, before the force is applied is unusually short and the bending force is therefore applied as early as possible. It is also possible to apply this force by a pressure-applying means arranged within the counterbeam, namely within the outlet funnel 15 of the tool 11. When the extruder 1 also is intended to make straight extrusions, the extrusion press operation is carried out without application of the force F.

The invention claimed is:

1. An extruder for making a curved workpiece, the extruder comprising:

an extruder frame including a counterbeam extending transversely of an extrusion direction and formed with a recess that is throughgoing in the direction;

a tool recessed in the recess and including a die having a downstream face spaced upstream in the direction from a downstream side of the counterbeam;

means for pressing a hot metal block against an upstream face of the die and thereby extruding a strand in the direction from the downstream face of the die; and means immediately downstream of the die for applying a transverse external force to the strand to bend it.

2. The extruder defined in claim 1 wherein the tool includes a pressure plate that extends completely through the counterbeam in the extrusion direction.

3. The extruder defined in claim 2 wherein the die and press plate form a funnel-shaped outlet opening flaring in the extrusion direction away from the downstream face of the die.

4. The extruder defined in claim 2, further comprising cylinders braced between the pressure plate and the die for pushing the die out of the pressure plate.

* * * * *